US006474468B1

(12) United States Patent
Griffith

(10) Patent No.: US 6,474,468 B1
(45) Date of Patent: Nov. 5, 2002

(54) PACK FOR SMOKING ARTICLES

(75) Inventor: Colin Griffith, London (GB)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/763,373

(22) PCT Filed: Aug. 18, 1999

(86) PCT No.: PCT/GB99/02735

§ 371 (c)(1),
(2), (4) Date: Feb. 20, 2001

(87) PCT Pub. No.: WO00/10879

PCT Pub. Date: Mar. 2, 2000

(30) Foreign Application Priority Data

Aug. 21, 1998 (GB) ..... 9818357

(51) Int. Cl.[7] ..... B65D 85/10

(52) U.S. Cl. ..... 206/267; 206/270; 229/117.03; 229/129.1

(58) Field of Search ..... 206/264–268, 206/270–273; 229/117, 117.01–117.03, 117.05, 117.06, 125.12, 125.125, 129, 129.1

(56) References Cited

U.S. PATENT DOCUMENTS

| | | | | | |
|---|---|---|---|---|---|
| 439,993 | A | * | 11/1890 | Bailey | 229/129.1 |
| 1,962,468 | A | * | 6/1934 | Stein | 229/129.1 |
| 3,311,283 | A | * | 3/1967 | Shimada et al. | 229/129.1 |
| 3,400,874 | A | * | 9/1968 | Shimada et al. | 229/129.1 |
| 3,933,299 | A | * | 1/1976 | Shimada et al. | 229/129.1 |
| 3,977,520 | A | * | 8/1976 | Grimm | 206/270 |
| 4,240,548 | A | * | 12/1980 | Stio | 206/270 |
| 4,646,960 | A | * | 3/1987 | Challand | 229/125.125 |

FOREIGN PATENT DOCUMENTS

| | | |
|---|---|---|
| CH | 598061 | * 11/1977 |
| DE | 2043043 | * 3/1971 |
| DE | 4217829 | * 12/1993 |

* cited by examiner

*Primary Examiner*—Jim Foster
(74) *Attorney, Agent, or Firm*—John F. Salazar; Middleton Reutlinger

(57) ABSTRACT

A cuboid pack for smoking articles is a shell and slide structure. The slide has a lid hinged on one minor side. Upon movement of the slide to an exposed position, hooks on the shell and slide interengage to pull open the lid via a tongue which is formed in part of an outer layer of a double layer side seam of the slide.

12 Claims, 4 Drawing Sheets

PACK FOR SMOKING ARTICLES

The present invention relates to packs for smoking articles, and in particular to packs for smoking articles having an inner slide and an outer shell (hereinafter referred to as slide-shell packs).

Slide-shell packs for smoking articles, such as cigarettes, differ from conventional hinged lid packs in that the smoking articles are provided in an inner shell which the user slidably moves relative to an outer shell to access the smoking articles. Some slide-shell packs have had a lid-opening mechanism that is activated by the movement of the slide within the shell.

Lid-opening mechanisms for slide-shell packs described in the prior art are mostly of the type having a connection between the outer shell and the lid of inner slide such that the lid is hinged open as the inner slide moves relative to the shell. The connection may be permanent (in which case it typically comprises an adhesive) or may rely on mechanical engagement between respective parts on the outer shell and inner slide. We are here concerned with lid-opening mechanisms which rely on mechanical engagement.

CH-A-598061 describes a cuboid slide-shell pack of conventional rectangular cross-section. The slide has a lid which includes a top wall and an upper portion of a rear side wall of the slide. The lid is hinged to the rest of the slide along a fold line at the lower edge of the upper portion of the rear side wall, and a tongue hangs from the top edge of the lid where the top wall meets the rear side wall. The tongue is folded upwardly and outwardly at a lower portion to form a hook. The outer shell carries an inwardly folded flap at an upper edge which engages with the hook when the inner slide is moved a given amount upwardly in the outer shell. This causes the tongue to exert a leverage on the top edge of the lid, and thereby hinge it open as the slide continues to move upwardly.

The construction of this lid-opening mechanism is relatively simple, but suffers a disadvantage in that an unattractive and weakening aperture is formed in the rear side wall as the lid hinges open and the tongue pivots about the top edge of the lid.

U.S. Pat. No. 4,646,960 teaches another version of a slide-shell pack having a hook and flap lid-opening mechanism, differentiated from CH-A-598061 only in that the tongue is cantilevered out from the rear edge of the lid. Again an aperture is left where the tongue material is cut from the rear wall.

U.S. Pat. No. 3,933,299 describes another cuboid slide-shell pack also having a hook and flap lid-opening mechanism at the rear of the pack. The disadvantage mentioned above is avoided by providing the hook on an extension to the lid. This extension double-backs from the front lip of the lid to the rear side wall of the inner slide. The extension provides at the rear side wall a second outer layer of material. The hook, being formed only from this outer thickness, is located adjacent an unapertured wall (i.e. the inner layer).

Although U.S. Pat. No. 3,933,299 shows how to avoid forming an aperture in the inner slide, it has the serious disadvantage of the consumption of additional pack material for manufacture of the extension.

The present invention overcomes the above disadvantages, and provides in a first aspect a cuboid pack for smoking articles, the pack having an outer shell and an inner slide;

the inner slide including a top wall and a minor side wall joined to the top wall at a top edge, the minor side wall having upper and lower wall portions and a fold line between the upper and lower wall portions, a lap seam of at least double layer thickness forming at least part of the minor side wall, the upper wall portion and at least part of the top wall forming a lid which is hingeable along the fold line;

the inner slide further including a tongue in the minor dimension of the pack and formed from the outer layer of the seam, an upper end of the tongue being attached to the upper wall portion at an attachment position above the fold line, and a hook at the lower end of the tongue;

the outer shell including a minor shell wall adjacent the said minor side wall of the slide, and having an engagement portion which is releasably engageable with the hook;

the inner slide being moveable relative to the outer shell, whereby upward movement causes the hook to engage with the engagement portion thereby hinging open the lid along the fold line.

The tongue will normally be formed integrally of the material of the outer layer of the seam of the side wall. It preferably occupies only a portion, such as for example a half or a third, of the minor dimension.

Unlike the packs described in U.S. Pat. No. 464,960 and CH-598061, in the pack of the present invention the inner layer of the lap seam can prevent an aperture being formed in the wall of the slide beneath the tongue as the lid is hinged open. However, usually a double layer seam, such as that from which the tongue is formed, is a necessary element in the construction of a slide from a folded blank. Therefore, in contrast to U.S. Pat. Nos. 3,933,299 and 4,646,960, no additional pack material need be consumed in the manufacture of the slide.

The engagement portion of the shell may conveniently be formed as an inner, downwardly-extending flap joined to the top edge of the minor shell wall, although other forms of engagement portion are not excluded. In a shell having a second minor shell wall opposing the first minor shell wall, a second engagement portion is preferably formed at the second minor shell wall such that the slide can be inserted into the shell in either of two orientations.

Preferably it is arranged that the tongue is formed from a portion of the outer layer of the lap seam which portion is spaced from the edge of the seam bounded by the free edge of the inner layer of the seam, so that the tongue is underlain by a completely continuous portion of the inner layer. Preferably also one edge of the tongue coincides with one edge of the outer wall. The pack is therefore stronger and more attractive.

Typically the lid includes a part of the top wall, the upper wall portion of the minor side wall, and opposing portions of the opposing major side walls of the slide. However, other lid configurations are not excluded.

An advantage of a lid hinged at a minor side wall and including only part of the top wall, compared with e.g. CH-A-598061, U.S Pat. Nos. 3,933,299 and 4,646,960 which show conventional hinged lids including all of a top wall and four major and minor side walls, is that a much lighter lid construction becomes possible. The hook and engagement portion mechanism therefore may be less robust. Also a lip may be provided to the lid simply by providing an extension portion to the part of the top wall included in the lid. The extension portion overlaps on that adjacent part of the top wall not included in the lid. Again, because the top wall is normally made of two layers of material, this does not involve wastage.

In a second aspect the invention provides a pack for smoking articles having an outer shell and an inner slide, the outer shell having a partial bottom wall allowing access to the base of the slide, and a plurality of substantially parallel side walls which form a guide tube for the inner slide;

the bottom wall being formed by gussets joining at least two pairs of neighbouring side walls along respective bottom edges, the planes which contain the neighbouring side walls forming an angle, and the gussets having a hinge line directed towards the apex of the angle, whereby folding the gussets about the hinge line enables the outer shell, absent the inner slide, to be flatly foldable, and unfolding the gussets enables the outer shell to be reerectable.

Preferably the gussets are triangular, and the shell is cuboid.

Of course, the shell of this aspect of the invention may be the shell of the slide-shell pack of the invention.

The outer shell of either aspect may have a plurality of through-holes, and the inner slide bear indicia on surfaces slidable adjacent the through-holes of the shell, at least one position of the slide relative to the shell providing an alignment of the indicia with the through-holes, at which position the indicia provide a recognisable representation viewable through the through-holes.

The invention will now be described by way of a specific embodiment, with reference to the drawings, in which.

Figure 1:
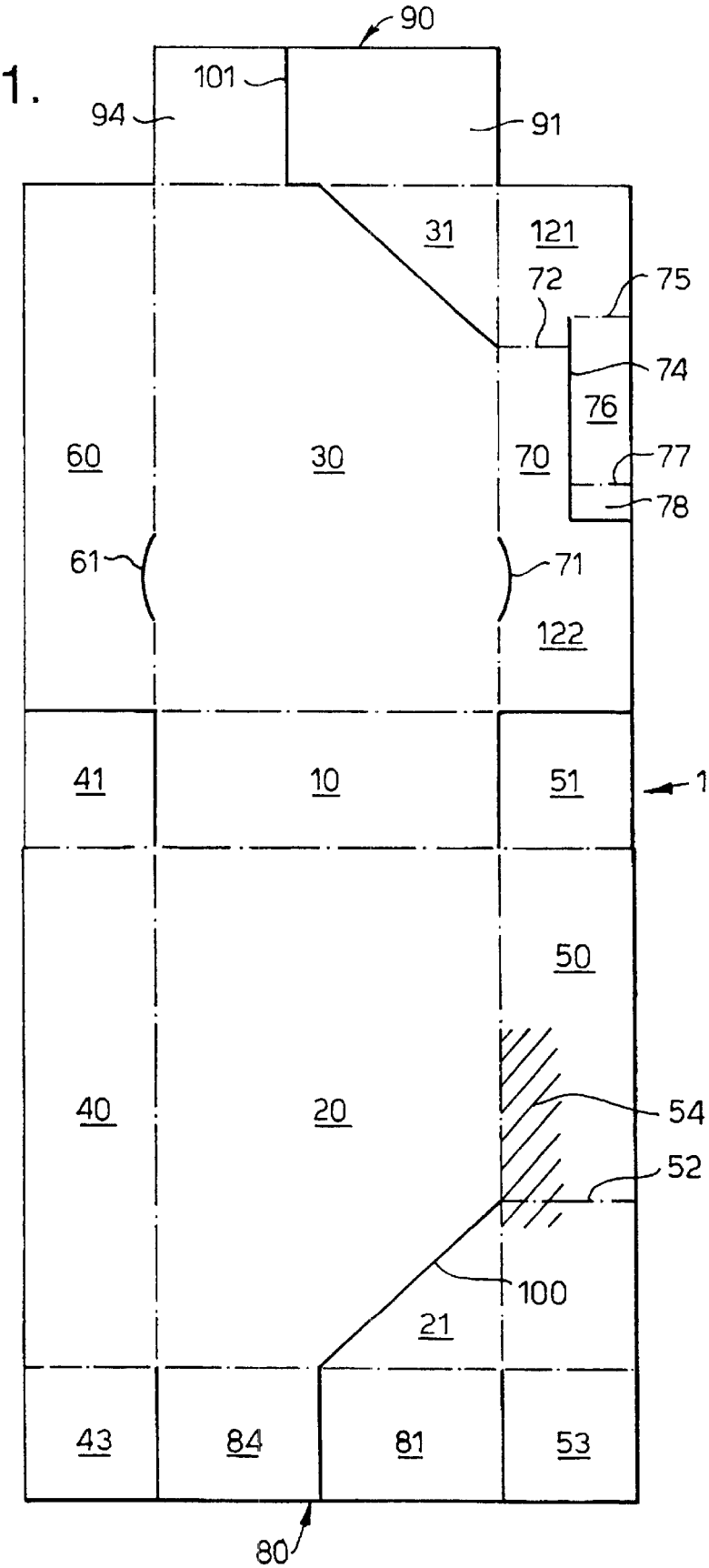
FIG. 1 shows a blank for forming the slide of a cuboidal slide-shell pack.

FIG. 1 shows a blank 1 for forming the slide 2 of a cuboidal slide-shell pack. The solid lines indicate cut lines in the blank, and the dashed lines indicate fold lines. The parts of the blank 1 are, for convenience, referred to by reference to the parts of the slide which they are intended to form.

Figure 3:
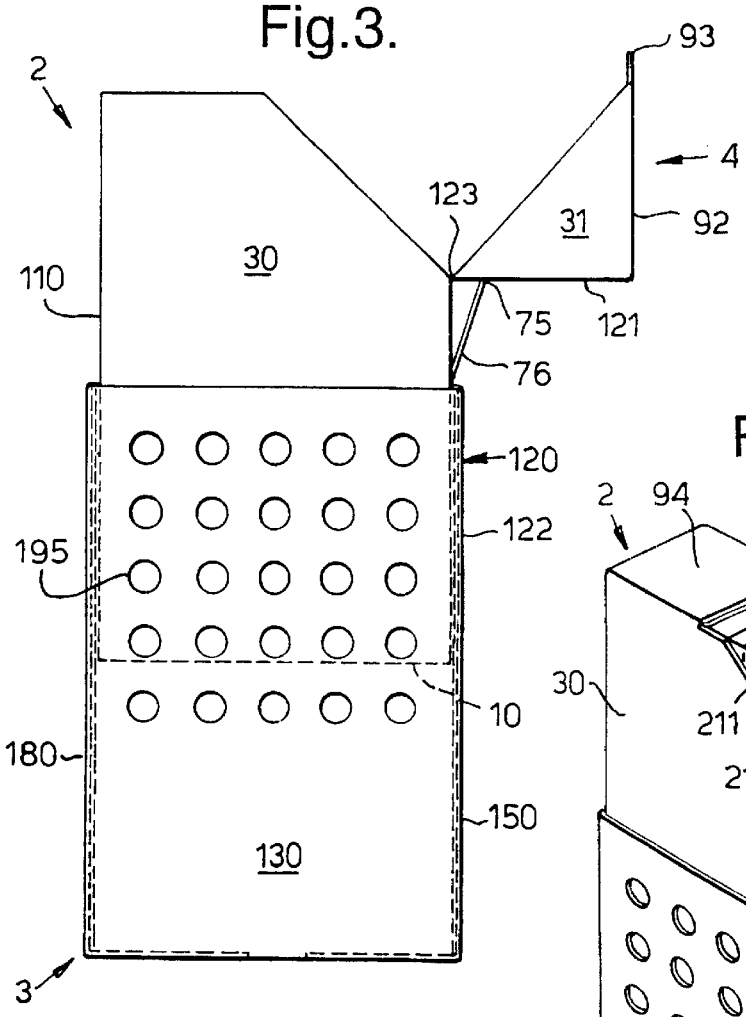
FIG. 3 is a diagrammatic side view of the slide-shell pack formed from the blanks of FIGS. 1 and 2, the slide being in a raised position with respect to the shell and the lid being in an open position.

FIG. 3 is a side view of this slide-shell pack, the slide being in a raised position and partly visible. Dashed lines indicate the outline of the slide hidden by the shell 3. A lid 4 is shown in an opened position.

The blank 1 has a rectangular bottom wall 10 which is coextensive at its long edges with short edges of respective rectangular major panels 20, 30.

The other short edges of the major panels are coextensive with respective long sides of rectangular top panels 80, 90. During formation of the slide from the blank, top panel 90 is overlain and secured to top panel 80 to provide a top wall of the slide.

The major panels 20, 30 are coextensive along their long edges with rectangular elongate side flaps 40, 50, 60, 70. The elongate side flaps 60, 70 of major panel 30 provide (upon folding of the blank about the fold lines) the outer layers of two lap seams which are the side walls 110, 120 of the slide, while the elongate side flaps 40, 50 of major panel 20 provide the inner layers of the lap seams. Ears 61, 71 project from the major panel 30 to provide increased frictional engagement with side walls of the shell into which the slide will fit.

The elongate side flaps 40, 50 used to form the inner layers of the side walls are coextensive at their bottom edges with bottom tabs 41, 51. During formation of the slide, the bottom tabs are folded about the boundaries they share with the elongate flaps 40, 50 and are adhered or otherwise secured to the inner side of the bottom wall 10.

The elongate flaps 40, 50 are also coextensive at their top edges with top tabs 43, 53. During formation of the slide, the top tabs are folded about the boundaries they share with the elongate flaps 40, 50 and are adhered or otherwise secured to the inner side of the top wall formed by top panels 80, 90.

The elongate flaps 50, 70 used to form minor side wall 120 (FIG. 3) are provided with respective fold lines 52, 72. In the completed minor side wall the fold lines 52, 72 lie directly adjacent to each other, both fold lines being essentially perpendicular to the length of the minor side wall. The minor side wall is therefore divided into upper 121 and lower 122 wall portions by the fold lines 52, 72, and the fold lines 52, 72 combine to provide a hinge 123 about which the lid 4 of the slide can pivot open.

The lid 4 of the slide comprises the upper wall portion 121, a rectangular part 92 of the top wall neighbouring the upper wall portion, and opposing triangular portions 21, 31 of major panels 20, 30. In order to achieve this, the blank is provided with cut lines 100, 101 which start at the ends of respective fold lines 52, 72, partition triangular panels 21, 31 from respective major side walls 20, 30, and divide each top panel 80, 90 into two parts. Parts 81, 91 of top panels 80, 90 are adhered together face to face to form the inner and outer layers of the lid. The outer part 91, being longer than the inner part 81, provides the lid with a lip 93. The remaining portions 84, 94 of panels 80, 90 are also secured together outside the tab 43 and are a partial permanent top wall of the slide. Portion 84 being longer than portion 94 offers accommodation of the single-thickness lip 93.

A cut line 74 extends part of the way along the longitudinal centre line of elongate flap 70. At the end of the line closer to the bottom wall 10 the cut line is then continued to the edge of the flap. At its other end the cut line terminates in the panel and a fold line 75 extends from the point of termination to the edge of the panel. The fold line 75 is parallel and above fold line 72, and a tongue 76 is thereby provided which in the completed slide is integrally attached to side wall 120 above combined fold lines 52, 72 which form the hinge 123 of the lid.

The tongue 76 is therefore formed from the outer layer only of the lap seam which itself forms side wall 120. The lap seam is a necessary element in the construction of the slide 2 from blank 1 and so the tongue is provided without wastage. Also construction of the tongue requires only a simple cut and fold to be made in the blank 1, and since it occupies only a portion of the width of the seam will always have a wall, formed by the inner flap 50, beneath it.

The hatched area 54 of elongate flap 50 indicates that portion which forms the area of the inner layer of the lap seam immediately beneath the tongue 76, but to which the tongue 76 is not adhered. During construction of the slide from blank 1 it is necessary to ensure that the adhesive used to form the lap seam is not provided between tongue 76 and area 54.

Clearly, by spacing the tongue from the boundary between major panel 30 and elongate flap 70 it is possible to provide a completely continuous wall beneath the edges of the aperture formed by the tongue, which gapes open when, as will be described, the lid 4 is moved to the open condition.

It is possible, but less desirable, to form the tongue from the entire width of elongate flap 70. If this were done, however, an edge of elongate flap 50 would be introduced into area 54. This is avoided by adopting the spacing and positioning described above.

In the present embodiment the tongue 76 occupies half the width of elongate flap 70. This is practical and attractive, but other configurations are possible which do not entail introducing an edge of flap 50 into area 54. For instance, the tongue may occupy a smaller fraction of the width such as one third or one quarter, or occupy part of the width but be positioned centrally to elongate flap 70.

Figure 6:
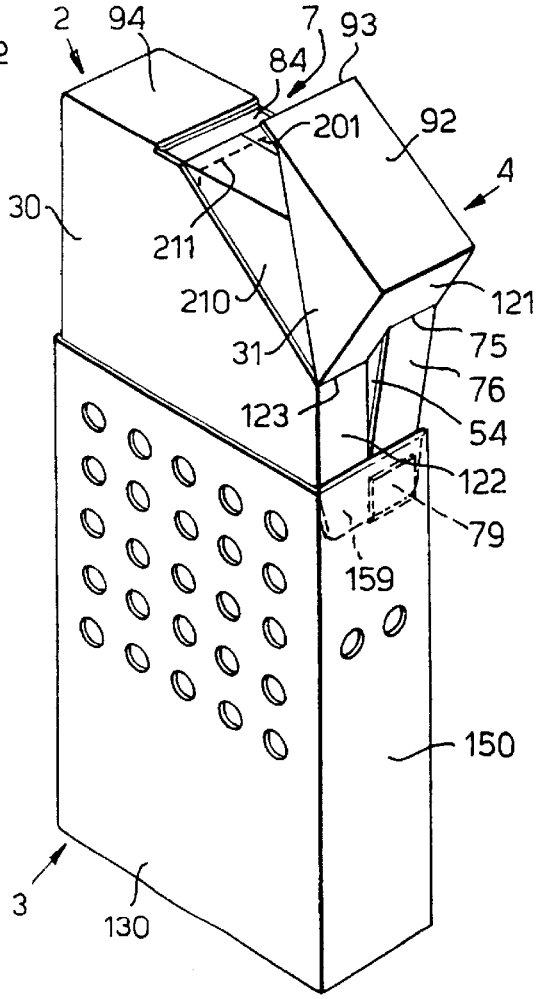
FIG. 6 shows the pack in operation with partial perspective views of the slide and shell.

A further fold line 77 is provided towards the free end of the tongue 76 such that the end of the tongue 78 can be folded upwardly and outwardly to form a hook 79 (FIG. 6).

Figure 2:
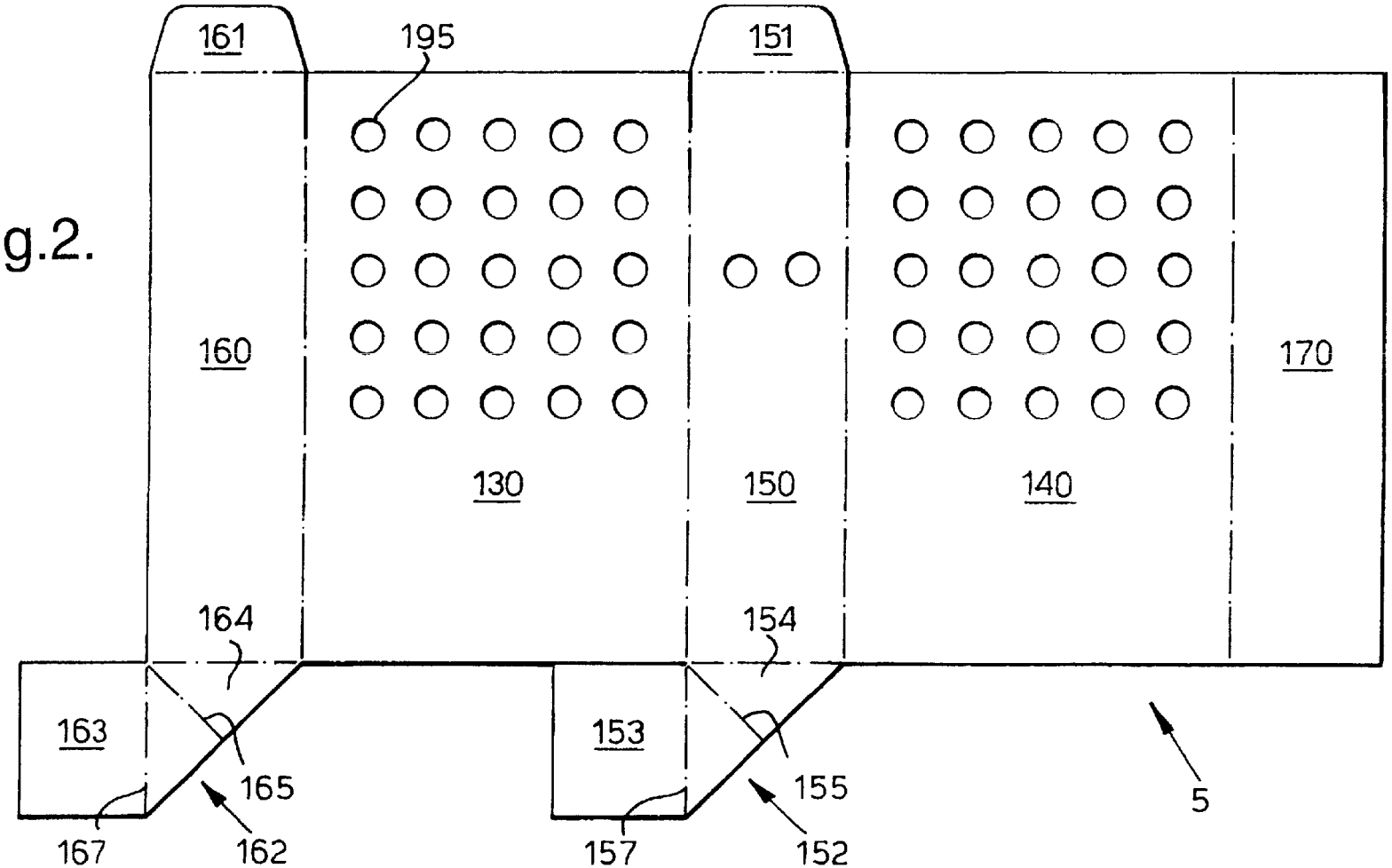
FIG. 2 shows a blank for forming the shell of the slide-shell pack.

FIG. 2 shows a blank 5 for forming the shell 3 of the slide-shell pack. Again solid lines indicate cut lines in the blank, dashed lines indicate fold lines, and the parts of the blank are referred to by reference to the parts of the shell which they are intended to form.

The blank 5 comprises two rectangular major shell panels 130, 140 each coextensive at a long edge with a respective long edge of a rectangular minor shell panel 150.

The other long edges of the major shell walls are coextensive with long edges of rectangular elongate flaps 160, 170. To form the shell, the shell panels 130, 140, 150 and elongate panels 160, 170 are folded about the fold lines which are their mutual boundaries, and the elongate flaps are overlain and adhered together. The adhered elongate flaps 160, 170 thereby provide another rectangular minor shell panel 180.

The blank also includes flaps 151, 161 which are coextensive with the upper short edges of shell panel 150 and elongate flap 160 respectively. In the finished shell, the flaps 151, 161 are folded inwardly through 180° about these upper short edges to provide two engagement portions for the hook of the slide. Because each minor shell panel has a flap, the slide can be inserted either way into the shell while still offering engagement for the hook.

Adjacent the lower short edges of shell panel 150 and elongate flap 160 are respective gusset panels 152, 162. The gusset panels have edges coextensive with these lower short edges. The gusset panels also have respective extensions 153, 163, which in the finished shell are adhered to the inner sides of major shell panels 130, 140 with fold lines 157, 167 flush with lower edges of those panels.

Figure 4:
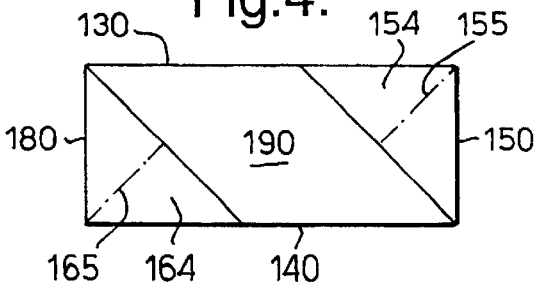
FIG. 4 shows a bottom view of the shell formed from the blank of FIG. 2.

FIG. 4 shows a bottom view of the shell formed from the blank of FIG. 2. The gusset panels 152, 162 provide a partial bottom wall. comprising two gussets 154, 164, with an access hole 190 through which the base of the slide can be accessed and pushed upwardly by a finger of a user.

Each gusset has a fold line 155, 165 directed to apex of the angle formed by the neighbouring shell walls. The shell, absent the slide, can therefore be folded flat in its assembled condition because the gussets are able to bend about their respective fold lines.

The shell panels 130, 140, 150 have an array of a plurality of circular through-holes 195 through which indicia (not shown) on corresponding surfaces of the slide are viewable to provide a recognisable representation. The array is in this embodiment square, but of course could be other shapes according to practical or aesthetic requirements.

The indicia may be, for example, numbers or letters which are straightforwardly viewable through the through-holes. Another possibility, however, is to disguise the representation in an abstract pattern of colour or shading. The indicia (i.e. the pattern) may then attractively and surprisingly provide the representation (which may be e.g. an array of through-holes in the form of an 'X', all the through-holes of the array displaying parts of the pattern having the same colour or tone) at a predetermined position of the slide in the shell. Different relative sliding positions may reveal different patterns or messages.

Figure 5:
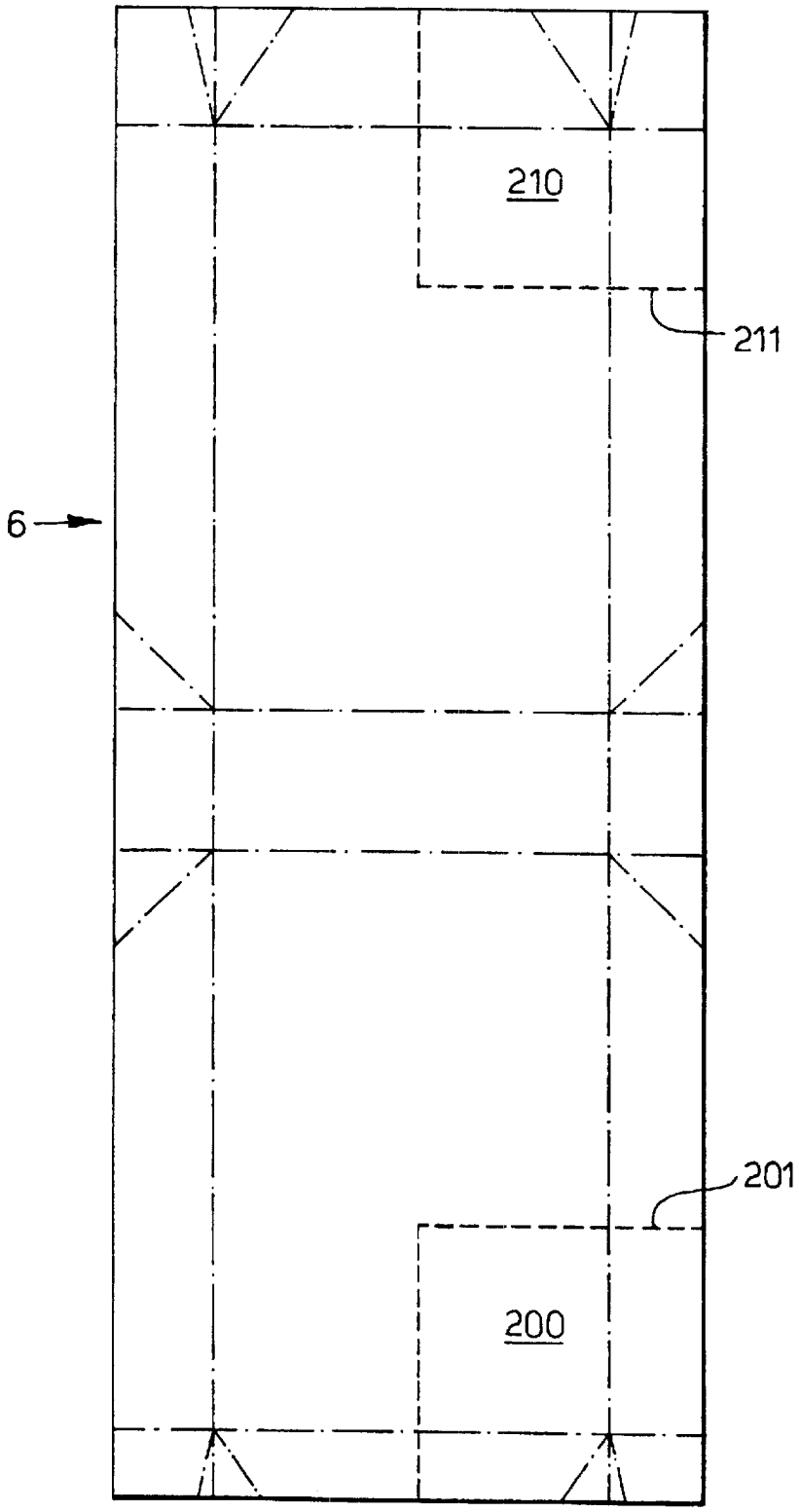
FIG. 5 shows a sheet for forming a cuboidal wrapped charge of cigarettes which are held in the slide.

FIG. 5 shows a sheet 6 for surrounding a cuboidal wrapped charge of cigarettes 7 which are held in the slide 2.

The sheet 6 is a rectangular foil-paper laminate and has two square corner portions 200, 210 which, when the completed wrap is held in the slide 2, are located at the part of the wrap adjacent the lid 4.

The corner portions 200, 210 are separable from the rest of the wrap along perforated lines 201, 211. By opening the lid and removing the corner portions, a means is provided for accessing the cigarettes held in the pack. In an alternative, an openable and reclosable envelope of wrap may be provided, as in a conventional soft pack for example.

FIG. 6 shows the pack in operation with the slide 2 pushed upward relative to the shell 3, and the hook 79 hooked to engagement portion 159 provided by folded down flap 151. Only the upper portions of the slide and shell are shown, and hidden features are outlined with dashed lines.

The tongue 76, being anchored at hook 79, exerts a leverage on the lid 4 to pivot it open about the hinge 123. Additional upward movement of the slide causes the lid to open further and reveal more of the wrapped charge 7. In providing this leverage, the tongue disengages from adjacent parts of elongate panel 70 (i.e. the outer layer of the lap seam forming side wall 120), and an aperture is formed in flap 70 which exposes area 54 of elongate panel 50 (i.e. the inner layer of the lap seam).

Upward movement of the slide is ultimately stopped by a) the user realising that the lid is sufficiently open, and (b) the base of the hook at fold line 77 meeting the projecting edge in the elongate flap 70 due to the folding back of that hook from the cut line 74 (the hook is constrained to lie adjacent the area 54 of elongate flap 50 by the inward pressure of the shell panel 150 and the resilience of the flap 151 or 161). In other embodiments the free end of the hook could meet the fold line at which the flap 70 is folded back, or the free ends of the hook and flap could abut, to define the opened position in each case, of course, with appropriate adjustment of their dimensions and positions.

When the lid is open, perforated lines 201, 211 allow the user simply to pull off and discard corner portions 200, 210 of the wrap so that the cigarettes are accessible.

To close the pack, the user pushes down on portion 94 of panel 90 and the slide starts to retract into the shell. The inherent resilience of the material of the slide provides a bias which at least partially closes the lid. Also the pressure and friction provided by the inner surface of shell panel 150 on the outer surface of the tongue provides additional bias.

Finally, when upper wall portion 121 starts to retract into the slide, shell panel 150 acts directly on the lid to effect closure of it.

If it is not desired that the shell be collapsible, a non-foldable end wall may be provided for it, but the end wall should have an aperture for allowing the user to push the slide with a finger or thumb.

The slide may be provided with an additional layer of card, primarily on the major face, to tighten its fit with the shell. This may be in addition or in substitution for the ears (61,71) on the slide. The is card may extend over the side walls of the slide and may itself provide ears for engagement with the shell.

What is claimed is:

1. A cuboid pack for smoking articles, the pack having an outer shell (3) and an inner slide (2);

the inner slide including a top wall and a minor side wall (70) joined to the top wall (7) at a top edge, the minor side wall (70) having upper (121) and lower (122) wall portions and a fold line (52,72) between the upper and lower wall portions, a lap seam of at least double layer thickness (50,70) forming at least part of the minor side wall, the upper wall portion (121) and at least part (92) of the top wall forming a lid (4) which is hingeable along the fold line (52,72);

the inner slide further including a tongue (76) in the minor dimension of the pack and formed from the outer layer (70) of the seam, an upper end of the tongue being attached to the upper wall portion at an attachment position (75) above the fold line (72), and a hook (78) at the lower end of the tongue;

the outer shell (3) including a minor shell wall (150,160) adjacent the said minor side wall (70) of the slide, and having an engagement means (151,161) which is releasably engageable with the hook (78);

the inner slide being moveable relative to the outer shell, whereby upward movement causes the hook (78) to engage with the engagement means (151,161) thereby hinging open the lid (4) along the fold line (52,72).

2. A pack according to claim 1 wherein the tongue (76) is formed integrally of the material of the outer layer of the seam of the side wall.

3. A pack according to claim 1 wherein the hook (79) and the tongue (76) are formed integrally of the material of the outer layer of the seam of the side wall.

4. A pack according to claim 1 wherein the engagement portion is an inwardly and downwardly folded tab (159) at a top edge of the minor wall (150) of the shell.

5. A pack according to claim 4 including a tab (159, 161) at the top edge of each minor side wall (150, 160) of the shell.

6. A pack according to claim 1 wherein the tongue (76) is a portion of the outer layer (122) which is spaced from the edge of the seam bounded by the free edge of the inner layer (50) of the seam.

7. A pack according to claim 1 wherein one edge of the tongue (76) coincides with one edge of the outer layer (70) of the seam.

8. A pack according to claim 1 wherein the shell has a partially open bottom end, the opening being defined by gussets (152, 162) between adjacent faces of the shell.

9. A pack according to claim 8 wherein each gusset (152, 162) is triangular and is bisected by a fold line (155, 165).

10. A pack for smoking articles having an outer shell (3) and an inner slide (2), the outer shell having a partial bottom wall allowing access to the base of the slide, and a plurality of substantially parallel side walls which form a guide tube for the inner slide;

the bottom wall being formed by gussets (152, 162) joining at least two parts of neighbouring side walls along respective bottom edges thereof, the planes which contain the neighbouring side walls forming an angle, and the gussets having a fold line (155, 165) directed towards the apex of the angle, whereby folding the gussets about the hinge line enables the outer shell, absent the inner slide, to be flatly foldable, and unfolding the gussets enables the outer shell to be reerectable.

11. A pack according to claim 10 wherein each gusset (152, 162) is triangular and is bisected by the fold line (155, 165).

12. A pack according to claim 10 wherein the outer shell has a plurality of through-holes (195), and the inner slide bears indicia on surfaces slidable adjacent the through-holes of the shell, at least one position of the slide relative to the shell providing an alignment of the indicia with the through-holes, at which position the indicia provide a recognisable representation viewable through the through-holes.

* * * * *